United States Patent [19]

Sandberg et al.

[11] 3,952,558

[45] Apr. 27, 1976

[54] MACHINE FOR DYEING OR OTHER WET-TREATMENT OF TEXTILES

[75] Inventors: Sven Olof Sandberg; Sven Robert E:son Smith, both of Avesta, Sweden

[73] Assignee: Avesta Jernverks Aktiebolag, Avesta, Sweden

[22] Filed: Apr. 1, 1974

[21] Appl. No.: 457,097

[30] Foreign Application Priority Data

Mar. 28, 1973 Sweden ..... 734386

[52] U.S. Cl. ..... 68/177

[51] Int. Cl.[2] ..... D06B 3/28

[58] Field of Search ..... 68/177, 178, 184; 26/21; 8/152

[56] References Cited

UNITED STATES PATENTS

| | | | |
|---|---|---|---|
| 3,670,531 | 6/1972 | Thies et al. | 68/178 X |
| 3,718,012 | 2/1973 | Vinas | 68/177 X |
| 3,771,337 | 11/1973 | Trullas | 68/178 |
| 3,780,544 | 12/1973 | Turner et al. | 68/177 |

FOREIGN PATENTS OR APPLICATIONS

| | | | |
|---|---|---|---|
| 244,287 | 10/1969 | U.S.S.R. | 68/178 |
| 1,314,080 | 11/1962 | France | 68/178 |

*Primary Examiner*—Stanley N. Gilreath
*Assistant Examiner*—Philip R. Coe
*Attorney, Agent, or Firm*—Walter Becker

[57] ABSTRACT

A machine for dyeing or other wet-treatment of knitted, crocheted or woven textile goods, and of the kind in which the textile goods in web form is driven around through a bath of treatment liquid by means of a driving nozzle supplied with treatment liquid under pressure and through which the textile goods is passed in the form of a string or rope, wherein the driving nozzle is directed towards a guide surface deflecting the liquid jet along with the accompanying textile string or rope leaving the driving nozzle in a downward direction, owing to the driving nozzle being disposed in such a position relative to the guide surface as to cause the jet and the textile string or rope to impinge the guide surface at an acute angle, and simultaneously spreading the jet along with the string or rope laterally to cause the textile goods to enter the liquid bath spread out into web form.

8 Claims, 7 Drawing Figures

MACHINE FOR DYEING OR OTHER WET-TREATMENT OF TEXTILES

The present invention relates to a machine for dyeing or other wet-treatment of knitted, crocheted or woven textile goods, and of the kind in which the textile goods in web form is driven around through a bath of treatment liquid by means of a driving nozzle supplied with treatment liquid under pressure and through which the textile goods is passed in the form of a string or rope. The driving nozzle is directed towards a guide surface deflecting the liquid jet along with the accompanying textile string or rope leaving the driving nozzle in a downward direction, owing to the driving nozzle being disposed in such a position relative to the guide surface as to cause the jet and the textile string or rope to impinge the guide surface at an acute angle, and simultaneously spreading the jet along with the string or rope laterally to cause the textile goods to enter the liquid bath spread out into web form. Such arrangement enables the speed at which the textile web is driven round through the bath of treatment liquid to be highly increased, thereby ensuring a more uniform dyeing or any other wet-treatment of the textile goods.

Further features and advantages of the machine according to the invention will appear from the following description in detail of various embodiments thereof in conjunction with the accompanying drawings, in which.

Figure 3:
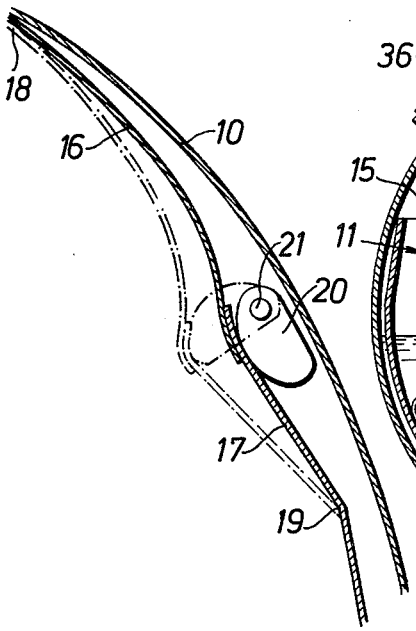
Figure 5:
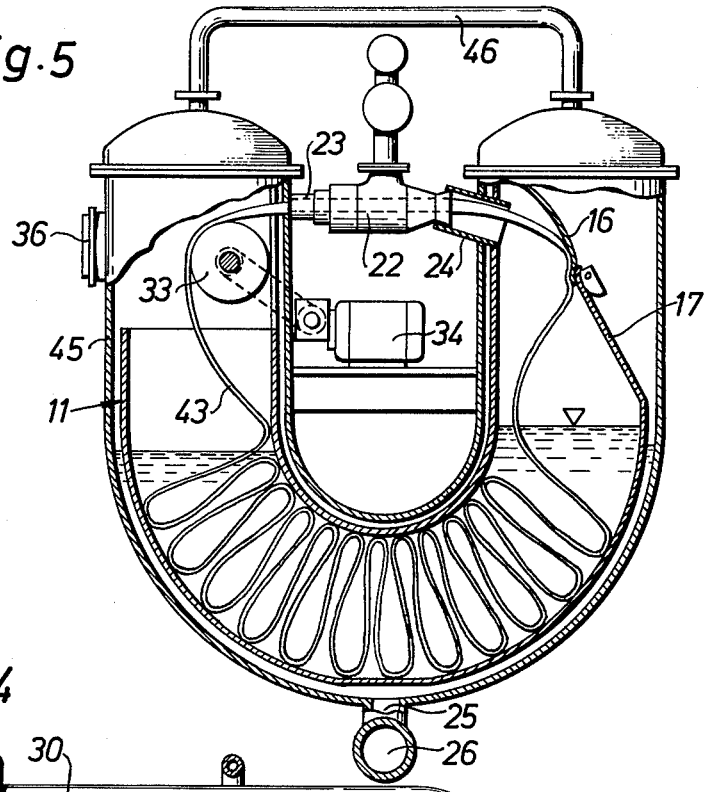
Figure 4:
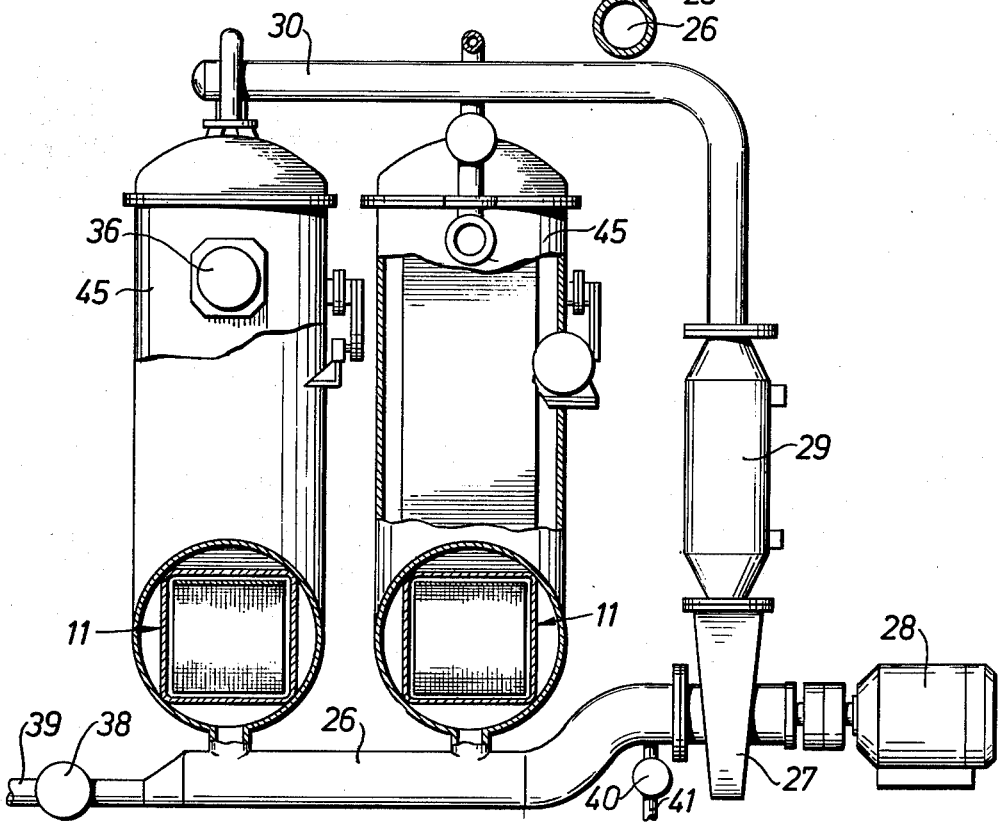
Figure 6:
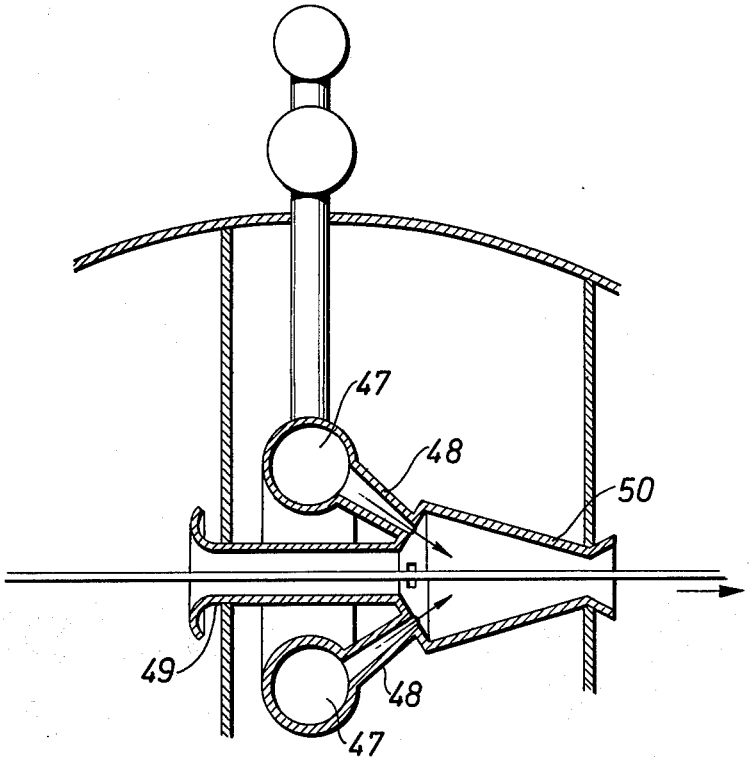

FIG. 3, on a larger scale, shows the system of adjustable guide-plates;

FIG. 4 is a side-view illustrating, with certain parts broken away, a second embodiment of the dyeing machine according to the invention;

FIG. 5 is an end-view of the dyeing machine according to FIG. 4 with certain parts broken away;

FIG. 6 shows an alternative constructional form of the driving nozzle; and

Figure 7:
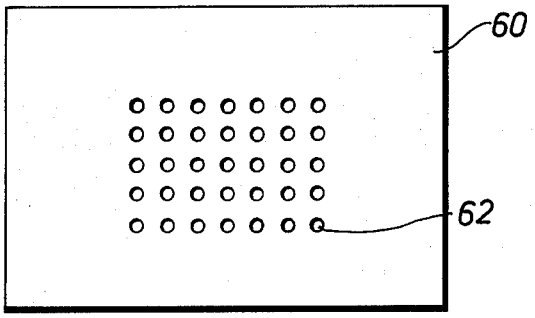

FIG. 7 shows an alternative constructional form of the guide plate.

Figure 2:
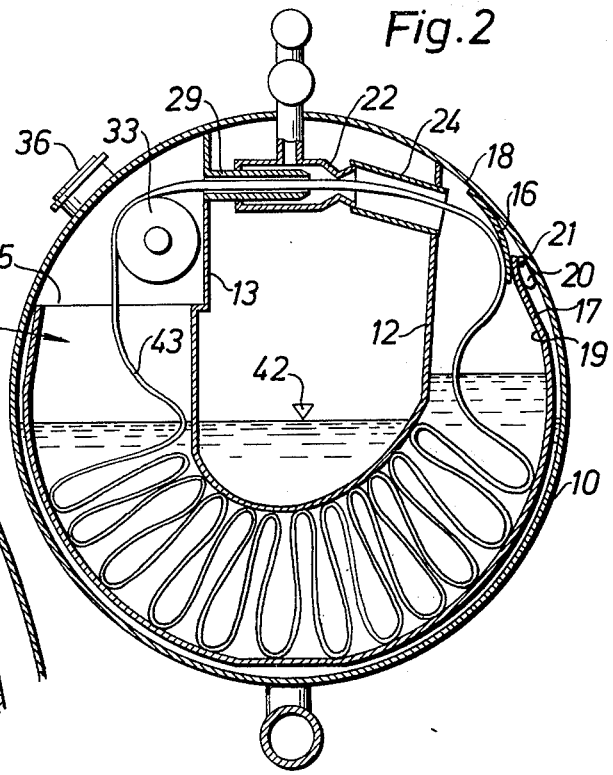
FIG. 2 is a cross-sectional view of the dyeing machine according to FIG. 1.
Figure 1:
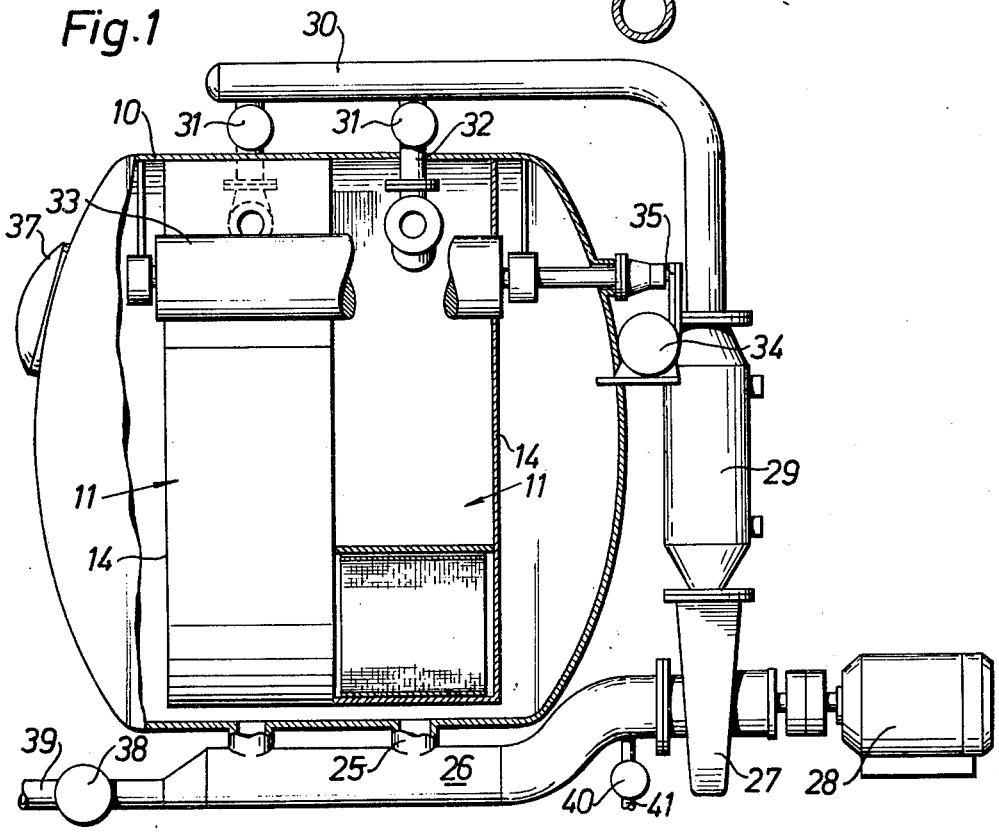
FIG. 1 is a side-view and partial vertical section of a first embodiment of a dyeing machine constructed in accordance with the invention.

In FIGS. 1 and 2, numeral 10 designates a closed container in the form of a horizontal cylinder with domed end walls. Suspended side by side within the container are two substantially J-shaped boxes 11 for receiving the goods to be wet-treated. The radially inner boundary wall of the J-shaped boxes comprises, at the right-hand box leg, as seen in FIG. 2, a flat portion 12 extending vertically upward to the container ceiling, and comprises at the left-hand box leg, as seen in FIG. 2, a slightly offset wall portion 13 also extending vertically to the container ceiling. The vertically extending flat sidewalls 14 of the boxes, at the right-hand leg extend upward to the container ceiling, whereas, at the left-hand leg, they only extend upward to the level 15, the boxes thus being open at this end.

The radially outer boundary wall of the boxes 11, at the right-hand leg extends with an inwardly curved portion thereby upwardly and into the angle between the container ceiling and the vertical wall portion 12. This inwardly curved upper wall portion is made up of two overlapping, concavely curved guide plates 16 and 17 being pivotable about upper and lower horizontally extending axes, 18 and 19, respectively, into different positions of adjustment by means of a cam 20 secured to a horizontally extending camshaft 21. As an alternative to this arrangement, the plates when subjected to adjustment could be resiliently deformed or flexed at their upper and lower ends, respectively.

Provided in the lower portions of the radially inner end outer boundary walls of the boxes 11 are a plurality of apertures through which the inner compartments of the boxes are in free communication with the liquid chamber outside the boxes.

Secured centrally above each box 11 and between the vertical wall portions 13 and 12 is a substantially horizontally extending driving nozzle consisting of a venturi nozzle 22 having an inlet tube 23 and a slightly downwardly inclined outlet tube 24. The maximum inclination of the ventury nozzle should be suitably ± 45° and preferably ± 20° to the horizontal. The venturi nozzle 22 is contained in a circulatory circuit for the treatment liquid comprising an outlet 25 from the container 10 beneath each box 11, an outlet manifold 26, a centrifugal pump 27 which is driven from an electric motor 28, a heat exchanger 29, a discharge pipe 30 from the latter, and two branched pipes 32 provided with respective control valves 31 and leading to the venturi nozzles, respectively. Mounted centrally above the outlet end of each box 11 is an in-feed drum or guide roller 33 which can be driven at a variable speed by an electric motor 34 through a bevel gearing 35.

Obliquely above the in-feed drum 33 and opposite each box 11, a loading opening is arranged in the peripheral wall of the container 10 and is normally closed by a cap 36. One end wall is provided with a manhole which is normally closed by a manhole cover 37.

The outlet or discharge manifold 26 can be connected to a discharge conduit 39 through a stop cock 38. Opening into the outlet manifold 26 near the pump 27 is a pipe 41 provided with a shut-off valve 40 and serving for introducing pigments into the machine from a metering or dispensing device, not shown.

The machine operates as follows:

After having supplied water or other liquid into the container 10 up to a level 42 such as to immerse the lower portions, at least, of the boxes 11 completely into the liquid, the machine is loaded with the web of fabric or any other textile material to be dyed or subjected to other wet-treatment. To accomplish this, after the pump 27 has been started and a forceful circulation of liquid through the venturi nozzles 22 has been initiated, then, after opening the cap 36, one end portion of the fabric web 43 is creased from both sides into a string or rope which is pushed through the inlet tube 23 and into the region of activity of the venturi nozzle 22. As soon as this region has been reached, the forceful jet of liquid will pull with it the fabric web which, after leaving the outlet tube 24, will drop down and successively fill the corresponding box 11. The fabric web folded in the box will move slowly towards the discharge end of the box under the influence of gravity and of the liquid flowing through the box. At a suitable instant before the fabric web has been pulled completely through the venturi nozzle, the associated control valve 31 is closed, after which the operator will fish up the leading end of the fabric web lying in the box and will sew this end together with the trailing end of the web. Thus, the length of fabric to be dyed now is in the form of an endless web extending over the in-feed drum 33 in a closed path through the venturi nozzle 22 and the box 11 immersed in the liquid supply.

After closing the feed-in caps 36, the control valves 31 are reopened and adjusted to a degree such as to cause the respective textile webs 43 to be pulled through the venturi nozzles 22 at a speed which has been found to be suitable in view of the particular nature of the textile web. The liquid will leave the outlet tube 24 as a forceful jet in which the fabric web is embedded. The jet impinges the guide plate 16 at an acute angle and will become deflected downwardly by the guide plate, at the same time being flattened and spread out laterally, whereby the textile web is forced to convert from a rope- or string-like into a substantially band-like configuration. The textile band 43 is folded automatically, somewhat in the manner indicated in the drawing, on top of the material already folded within the box 11. The jet, because of the restriction of the venturi nozzle, as shown in FIG. 2, will converge at a point disposed a certain distance after the passage through tube 23 so as to attain, together with the textile web a minimum cross-sectional area within tube 24. After this point, the jet along with the fabric web will diverge or expand so as to attain a cross-sectional area which is greater than the cross section of the fabric web within tube 23, before they will impinge the guide surface. This arrangement has been found to be of advantage, and therefore there should preferably exist a certain minimum distance between the venturi tube and the guide surface in order to attain this effect.

The continuous supply of liquid into the box 11 will cause the liquid level in the right-hand box leg, as seen in FIG. 1, to rise above the liquid level within the container 10, and in continuous operation the liquid will flow slowly through the box and out through the apertures in the outer and inner boundary walls of the box, thereby facilitating the gravitational passage of the folded material through the box.

Experiments made have shown that it is possible, in a machine constructed in accordance with FIGS. 1 and 2, to let the textile material circulate through the nozzle and liquid bath at a speed several times that which was possible to attain in previously known machines of a similar type, and this without the necessity of increasing the pressure height of the pump. The speed can be selected to be as high as 600 to 700 meters per minute, to be compared with a maximum of about 200 meters per minute in prior-art machines. This involves that the dwell periods of the material within the respective boxes will be highly shortened. If the textile web is assumed to have a length of 300 meters, and the speed of propulsion through the driving nozzle is assumed to be 600 ms./min., then it will only take half a minute for a specific portion of the textile web to pass through the box 11 from the inlet to the outlet end. This will imply that the material will only during a very short period occupy the same position within the box, thereby avoiding creasing and thus non-uniform dyeing caused thereby.

Another advantage of the high speed resides in a diminishment of the temperature difference between the textile material and the treatment bath in the driving nozzle. A further advantage relating to dyeing is that the colour distribution over the textile goods will be more uniform.

When a suitable feed speed through the venturi nozzles 22 has been reached and a satisfactory folding-down of the material into the box has been attained by proper adjustment of the guide plate 16, the cock 40 provided in the pipe from the metering or dispensing device is opened for supplying pigment matter to the water or other liquid within the container, thereby starting the dyeing operation proper. This operation is continued until the treatment with dyeing liquid has given the desired result.

The embodiment shown in FIGS. 4 and 5 mainly differs from that shown in FIGs. 1 and 2 merely by the fact that the cylindrical container common to a plurality of boxes 11 has been replaced by individual containers 45 for the respective boxes. The container 45 associated with each box 11 has the configuration of a U and is circular in cross section. The venturi nozzle 22 with its inlet tube 23 and outlet tube 24 is no longer disposed within the container, but extends outside the container, between the two legs thereof. Such arrangement, too, involves a low lifting height for the textile web from the outlet end of the box 11 to the feed-in drum or guide roller 33. Extending between the tops of the two legs of container 45 is a pressure equalizing pipe 46.

In the modified form of the driving nozzle as shown in FIG. 6, treatment liquid at high pressure is admitted into an annular chamber or manifold 47 from which a row of circumferentially spaced jet nozzles 48 converge inwardly. The forceful liquid jets from these nozzles will impinge the textile material fed in through the inlet tube 49 in a rope-like form and will force the textile rope with it out through the outlet tube 50 from which the treatment liquid is discharged in the form of a forceful free jet. The latter will be deflected downward when impinging an inclined guide surface, as described hereinbefore.

FIG. 7 illustrates the feature of providing the guide surface, here designated by 60, within the region of impingement of the liquid jet and the fabric web, with holes 62. Such design has been found to be particularly suitable for certain types of textile goods, owing to the fact that a portion of the liquid of the jet will thereby be deflected into the space existing between the container 10 and box 11 which will result in an improved spreading of the fabric string or rope laterally.

The invention, of course, is not restricted to the embodiments illustrated in the drawings and described in detail hereinbefore, since many modifications are conceivable without departing from the scope of the invention. In particular, the hydraulic driving nozzle may be of different design. The guide surface need not necessarily be provided by an adjustable guide member, but may instead be fixed, for instance may be an integral portion of the treatment-liquid container wall.

What we claim is:

1. Apparatus for dyeing or other wet-treatment of knitted, crocheted or woven textile goods, comprising a vessel containing a bath of treatment liquid, means for circulating the textile goods in web form through said bath, means including a driving jet nozzle above said bath supplied with part of said treatment liquid under pressure for producing a jet drawing the textile goods in the form of a string or rope through said nozzle, the driving nozzle being directed at an angle within the range of + 45° to the horizontal towards a deflector surface for deflecting the jet and the accompanying textile string or rope in a downward direction towards said bath, said jet nozzle and said deflector surface being separated by a space allowing said web to be carried substantially solely by said jet and unobstructed to said deflector surface to impinge thereagainst so as to spread the jet and the string or rope laterally to cause the textile goods to enter the liquid bath spread out into web form, and means for adjusting said deflector surface into various angular positions.

2. Apparatus as claimed in claim 1, wherein said deflector surface is concavely curved.

3. Apparatus as claimed in claim 1, wherein said deflector surface forms an upper portion of an outer boundary wall of said vessel.

4. Apparatus as claimed in claim 1, wherein at least one guide roller for guiding the web to said nozzle is arranged to be driven positively at a controllable peripheral speed such as to cause the web to enter the driving nozzle in a tensioned condition.

5. Apparatus as claimed in claim 1, wherein the textile goods are driven around within the machine in the form of an endless web.

6. Apparatus as claimed in claim 1, wherein said driving nozzle is disposed at an angle within the range of $\pm$ 20° to the horizontal.

7. Apparatus as claimed in claim 1 wherein said deflector surface is perforated within its region of impingement for the liquid jet and textile string or rope.

8. Apparatus for wet processing textile material, comprising in combination (a) a vessel containing a bath of treatment liquid, (b) means for circulating a textile material in the form of an endless web along a path extending in part through said bath, said means including a jet nozzle extending substantially horizontally above said bath, said jet nozzle having an inner passage and a nozzle outlet through which said web passes in turn when the apparatus is in use, and deflecting means which includes guide plate means spaced from said nozzle outlet in a horizontal line and adjustable to different angular positions and having a deflecting surface at an acute angle relative to said horizontal line for deflecting the jet and the web carried thereby at an acute angle downwardly towards said bath, said deflecting means including means to hold said guide plate means with the deflecting surface in the angular position to which the guide plate means is moved, and means for supplying a portion of said treatment liquid to said nozzle under pressure for producing a jet of said liquid drawing said web in rope or string form through said passage and carrying it through the space between said nozzle and said deflecting means to be deflected by said deflecting surface.

* * * * *